United States Patent [19]

Michel

[11] Patent Number: 4,982,528

[45] Date of Patent: Jan. 8, 1991

[54] PRISON CELL LOCKING AND UNLOCKING DEVICE

[76] Inventor: Justin F. Michel, 5526 Pinecrest Dr., Cincinnati, Ohio 45238

[21] Appl. No.: 277,303

[22] Filed: Nov. 29, 1988

[51] Int. Cl.[5] ..... E05B 47/00

[52] U.S. Cl. ..... 49/16; 49/18; 49/20

[58] Field of Search ..... 49/15, 16, 17, 18, 20

[56] References Cited

U.S. PATENT DOCUMENTS

| | | | |
|---|---|---|---|
| 1,030,699 | 6/1912 | Youngblood | 49/17 |
| 2,792,917 | 5/1957 | Smith et al. | 49/20 X |
| 3,837,117 | 9/1974 | Butt | 49/18 |
| 3,866,354 | 2/1975 | Butt | 49/16 |
| 3,913,263 | 10/1975 | Butt | 49/18 X |
| 4,641,458 | 2/1987 | Pilcher et al. | 49/18 X |
| 4,723,373 | 2/1988 | Jump | 49/18 |

*Primary Examiner*—Lloyd A. Gall

*Attorney, Agent, or Firm*—Wood, Herron & Evans

[57] ABSTRACT

A prison cell door locking device which responds to four locking modes of a prison cell locking system which uses a master bar assembly controllable from a central location to (1) release the locks of all cells, (2) lock all of the cells, (3) allow key operation of the locks at each individual cell, or (4) allow electric operation of the cell locks from the central location is provided. The device is fully assembled on a mounting plate which is provided with means for alignment with and securing onto the frame of a prison cell, and for connection to the cell door locking member. The assembled device contains mechanical and electrical components to operate the cell locks in all four modes. The device includes a master bar section which is permanently connectable into the master bar assembly, without further alignment, by long hollow channels of light weight metal. The device includes a drop bar head which carries a roller which locks the cell door by engaging a stepped notch in a roller bar by which the cell door is hung, the roller bar holding the drop bar head out of its locking position unless the door is either fully opened or closed.

21 Claims, 9 Drawing Sheets

PRISON CELL LOCKING AND UNLOCKING DEVICE

The present invention relates to prison cell locking systems and more particularly to devices for use in connection with such systems in which the cell doors of a plurality of prison cells are locked and unlocked in a plurality of modes.

Prison cell locking systems have been provided by the prior art which enable both remote and local operation of the cell door locks as well as the selective or simultaneous operation of the locks from a remote location. Such devices of the prior art have provided for both mechanical and electrical locking mechanism actuation. A need has been recognized in the prior art for enabling locking devices to operate in a plurality of modes.

The prior art has provided prison cell locking systems with cell door locking and unlocking devices at each cell which operate through the manipulation of a master control bar. The bar links the cell door locking mechanisms of a plurality of cells, particularly adjacent cells which face a common corridor. It is conventional that such devices respond differently to four typical positions of the master bar. In one such position of the master bar, the cell locking mechanisms are enabled to be electrically operated remotely from a central location to lock or unlock cell doors selectively, cell by cell, or in response to a master switch for all of the cells. In a second position of the master bar, such mechanisms are enabled so that selective cell doors may be manually opened by a guard through the use of a key at the cell. In the third position, such mechanisms are operated by the master bar to release all cell locks. In a fourth position of the master bar, such mechanisms are operated by the master bar to lock all cells simultaneously and to disable all other means for unlocking the cells.

The first, or electric control position, is the normal operating position. The second, or manual position, is used when cells are to remain locked, such as at night, but when guards may have occasion to open an individual cell door, for example, to aid a prisoner, based on a decision made while inspecting a cell. The third position, the gang-open or release position, is particularly useful in emergency situations such as fire when evacuation of all cells must be provided for. The fourth or "dead-lock" position may be used to secure all cells in case of riot, for example, or other emergency.

Each of the cell doors of such prior art systems has been provided with a lock bolt in the form of a drop bar which will operate to lock the cell under the force of its own weight unless the mechanism for unlocking the door is otherwise activated.

In the prior art, many cell door hanging structures are for doors of the sliding type which reciprocate between open and closed positions by movement on a roller track. In some prior art systems, cell doors are mechanically or electrically driven between their open and closed positions, and cannot be moved without operating the drive mechanism. In less than maximum security applications such as minimum or medium security installations, it is becoming recognized that it is desirable that only the locks of the doors be controlled, and the cooperation of the prisoner is required to move the door once the locking device is activated and the door lock released. Locking devices for such doors are referred to as "release" mechanisms. Doors used with release mechanisms are provided with means such as spring loaded mechanisms to jar the doors away from their closed position once the lock is released so as to allow the door to be thereafter movable manually to either the open or closed position by the prisoner.

Doors which can be moved by prisoners can, however, present a danger to guards or other prisoners when unlocked. This is because a prisoner can move the heavy door, and with it deliberately injure a guard or a fellow prisoner. Hinged cell doors are particularly dangerous in this regard.

Prison cell door locking mechanisms of the prior art which employ sliding doors and the master bar control features referred to above in minimum or medium security applications have rendered the sliding door systems more expensive than those with doors of the swinging type. Furthermore, such devices have been exceptionally difficult to install and maintain.

Prior art locking devices have been difficult to repair, and have required that the mechanisms be exposed for too long a time. This exposure of the internal components increases the likelihood that prisoners will gain knowledge which can be used to defeat or tamper with the devices. In addition, the exposed mechanisms are susceptible to damage and collection of dirt particularly during installation when the structural members on which the components are mounted are being welded or cemented in place.

There is, and has remained for many years, a need for a prison door locking device which has the features of the prior art systems, but which is less expensive, more reliable and easier to install and maintain from prior art devices, and which can replace the devices of the prior art without replacement of the entire system, and without excessive cost and difficulty of installation.

It is a primary objective of the present invention to provide a prison locking system and more particularly a prison cell door locking and unlocking device for such a system which provides the needs of the prior art described above, but with reduced complexity and cost. Particularly, it is an objective of the present invention to provide a cell door locking and unlocking device which reduces the cost of such a system, particularly one having sliding type cell doors, and which has the above described features, but which is less expensive than many of the prior art systems including many of those with swinging cell doors.

It is a further objective of the present invention to provide a prison cell locking and unlocking device which may be installed as a complete assembled unit in the cells of a prison cell system without complex adjustment, in a minimum amount of time, and with a minimum amount of expertise and effort. It is a particular objective of the present invention to provide such a device which can be installed in pre-existing cell locking systems to replace devices which they are improvements upon.

It is another objective of the present invention to provide a locking mechanism which can be stored in pre-assembled condition until the cell structure and construction are completed to protect it from damage and to keep it clean, and which can be exchanged in its entirety to minimize the time that the mechanism will be opened during repair.

According to principles of the present invention, there is provided a prison cell locking device which contains all components necessary to operate in the various modes controlled by a system master bar. The assembled unit is capable of installation by alignment with the door latching components assembled with the door and structure at the prison cell, and to thereby self align the device components with cooperating cell door components as the device is installed. The device carries with it a pre-aligned segment of the master bar assembly which can be linked as it is assembled into master bar assembly system.

The device can be used for doors which open either to the right or to the left, with a single design configuration. The device, though particularly advantageous in sliding door installations, provides advantages also if used with doors of the swinging type. The device is also effective to lock the doors in "release" type door locking systems in either the door open or door closed position.

Upon assembly of the preferred embodiment of the invention, the electrical and mechanical lock actuating components are directly linked to the latching mechanism of the cell door, and include a minimum of components in pre-assembled relationship on the plate shaped chassis which is the support of the device. The master bar linkage, according to a preferred embodiment of the present invention, includes a long, light weight channel shaped link for permanent connection to the pre-aligned master bar segments of the devices in adjacent cells. Preferably also, the latching mechanism of the movable cell door is equipped with a spring biased stepped roller bar which cooperates with the locking mechanism of the device to either lock the cell door or to hold the door locking mechanism in the unlocked condition.

The present invention provides the advantages of a simple, easy to install, easy to replace and easy to repair locking device for a prison cell locking system which greatly reduces the cost and maintenance and the installation time over devices of the prior art. The present invention provides the device which will operate in the various modes of the previous systems. It also is capable of replacing obsolete or worn out devices of the prior art with improved devices without total replacement of the locking system.

These and other objects and advantages of the present invention will be more readily apparent from the following detailed description of the drawings which illustrate the preferred embodiments of the present invention, and in which:

DETAILED DESCRIPTION OF THE DRAWINGS

Figure 1:
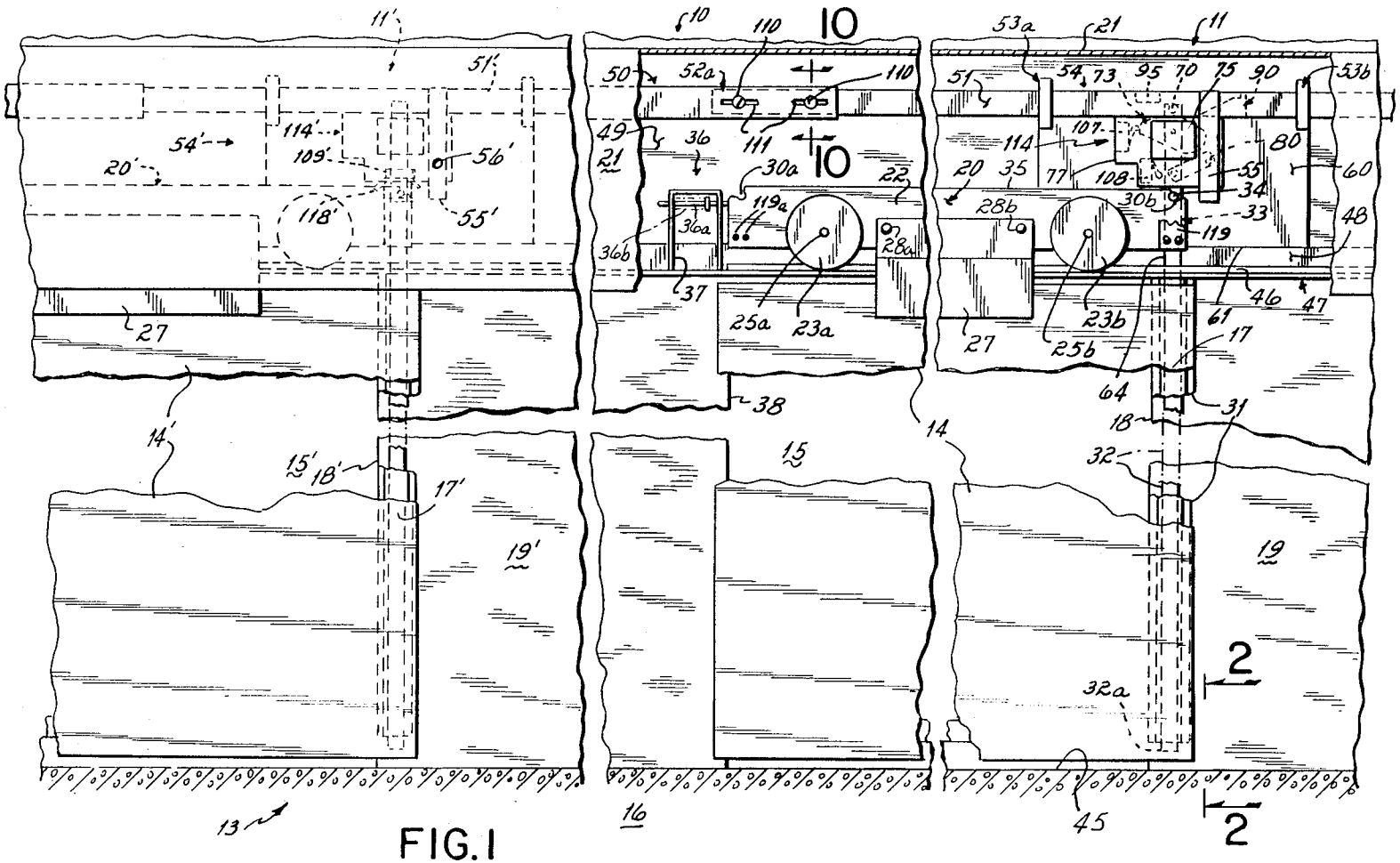
FIG. 1 is an elevational view, partially broken away and having parts removed for clarity, of a prison cell locking system which includes a cell door locking device according to principles of the present invention, with the prison cell doors shown locked in a closed position with the lock operating mechanism of the system set in the electrical control position.

Referring to FIG. 1, a prison cell locking system 10 is illustrated. The system 10 controls the locking and unlocking of the cell doors of a plurality of prison cells arranged in one or more rows. The system 10 includes a first cell 11 and a second cell 11', both arranged in the same row of cells 13, as illustrated in FIG. 1. The cells 11, 11' as arranged in row 13 each have a cell door 14, 14', each shown in FIG. 1 in a closed position and closing the cell door openings 15, 15'. The cell door openings 15, 15' face in a common direction onto a corridor 16.

The cell doors 14, 14' are sliding cell doors of a conventional solid or barred type slightly wider than the door openings 15, 15' which they are designed to close. Typically, the cell doors 14, 14' would be approximately 32" in width with the openings 15, 15' being slightly narrower, for example, 30" in width. As such, when the doors 14, 14' are closed as shown in FIG. 1, overlaps 17, 17' of approximately 1" to 2" will be provided between the doors 14, 14' and door frames 18, 18' in the front walls 19, 19' of the cells 11, 11', respectively. The overlaps 17, 17' are shown to the right of the door openings 15, 15' in FIG. 1.

Referring to cell 11, the door 14 is hung on a roller bar assembly 20 mounted above the door opening 15 behind a transom plate cover 21. The roller bar assembly 20 includes a horizontally extending rectangular steel roller bar 22 having a length approximately equal to the width of the door 14. A pair of rollers 23*a* and 23*b* are rotatably mounted to the front surface of the roller bar 22 through a pair of axles 25*a* and 25*b*, respectively. The axles 25*a* and 25*b* preferably take the form of bolts which are plug welded or otherwise rigidly secured to the roller bar 22 at the back ends of the axles 25*a*, 25*b*. The rollers 23*a* and 23*b* are rotatably connected to the axles 25*a*, 25*b* through bushings which surround the axles 25*a*, 25*b* as illustrated, for example, by bushing 26*b* in FIG. 4.

The door 14 is hung from the roller bar 22 through a double angled hanger bracket 27. The hanger bracket 27 is bolted or otherwise rigidly connected at its upper end to the roller bar 22, preferably through a pair of bolts 28*a* and 28*b* and rigidly secured at its lower end to the door 14 preferably by welding so that the door cannot be detached by prisoners.

The roller bar 22 has a pair of notches 30*a* and 30*b* in the upper left and right hand corners, respectively, thereof as viewed in FIG. 1. The notches 30*a*, 30*b* provide the primary locking means through which the door 14 is locked in either its open or its closed positions, respectively. A locking bar channel 31 is provided which completely encloses a lock bar 32 which is vertically oriented and mounted to slide in the channel 31. The lock bar 32 also is part of the door locking means. The channel is situated in the door frame 18 in the region of overlap 17 between the closed door 14 and the cell wall 19.

Figure 9:
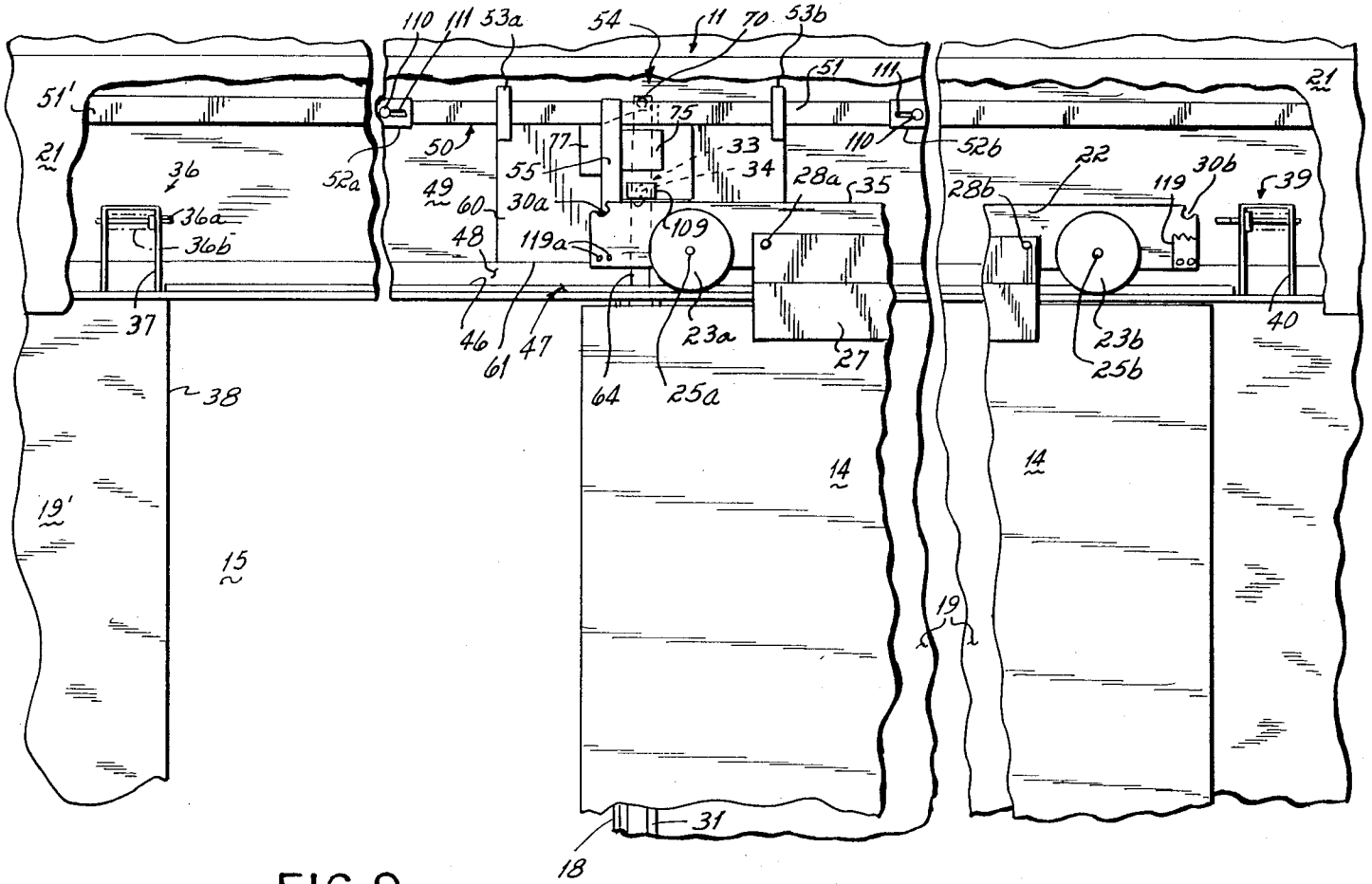
FIG. 9 is a elevational view of the system of FIG. 1 but illustrating the doors of the prison cell open with the lock operating mechanism in the gang-open position, and the locking device set as in FIG. 8.
Figure 12:
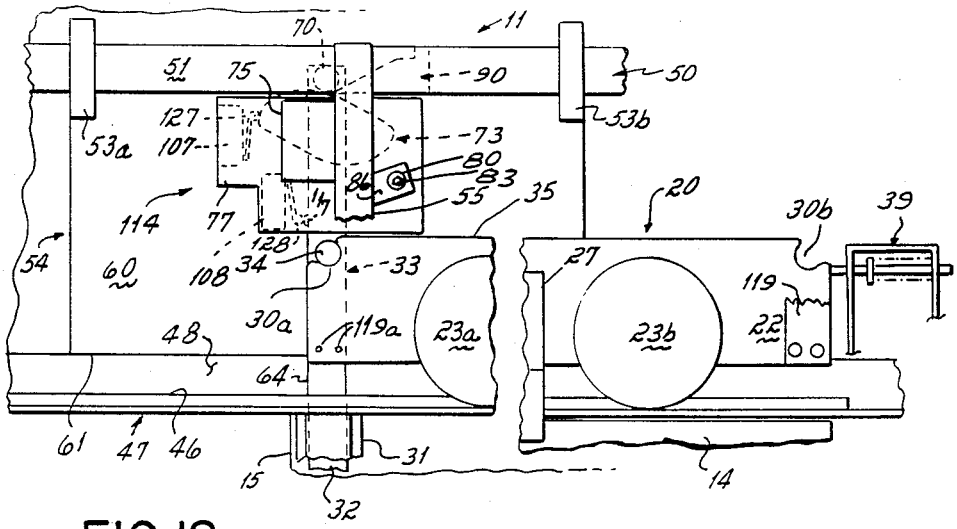
FIG. 12 is a view similar to FIG. 11 but with the master bar in the key position, the electric door mechanism deactivated and the door locked in the open position.

The bar 32 has connected at the upper end thereof in the region behind the transom plate cover 21 a movable locking member in the form of a lock bar head assembly 33. Rotatably mounted on the lock bar head assembly 33 is a roller 34 positioned so as to fit in either of the notches 30*a* or 30*b* to function as a locking bolt to immobilize the door 14 when the head 33 is in a locking position. The roller 34 will also roll on the upper edge 35 of the roller bar 22 when the lock bar head 33 is in a raised or door unlocking position and the door 14 is capable of being manually moved by a guard or, more typically, by the prisoner. The roller 34 when positioned in the notch 30*b* holds the door 14 in its locked closed position as shown in FIG. 1. When positioned in notch 30*a*, the roller locks the door in its open position (FIG. 12). The roller 34, when positioned in the notch 30*b*, retains the roller bar 22 against a compressed kicker spring assembly 36 fixedly mounted on a bracket 37 near the left frame member 38 above door opening 15. The kicker spring assembly 36 includes a plunger 36*a*, one end of which is urged toward and against the roller bar 22 by a helical compression spring 36*b*. A similar kicker spring 39 (FIG. 9) to the right of the door 14 above the right frame 18 is compressed by the roller bar 22 when the roller 34 is in the notch 30*a* and the door is locked open. As seen in FIG. 9, the right, or door open, kicker spring assembly 39 is fixedly mounted on bracket 40 with respect to the right door frame 18. The roller 34, when positioned in either of the notches 30*a* or 30*b*, retains the roller bar 22 against, and compresses, the kicker spring assemblies 39 and 37, respectively.

When the drop bar head 33 is elevated, the roller 34 releases from the notch 30*a* or 30*b*, and the respective kicker spring assembly 36 or 39 will move the roller bar assembly 20 such that, when the head 33 is again dropped, the roller 34 will rest upon the upper edge 35 of the roller bar 22. See, for example, FIG. 13. The lock bar 32 is of the drop bar type, tending to move downwardly under its own weight carrying with it the drop bar head 33. When the door 14 is urged to the left as in FIG. 1 such that the roller bar 22 compresses the plunger 36*a* against the spring 36*b* of the kicker spring assembly 36, the roller 34 will drop into the notch 30*b* as the lock bar 32 falls downward to lock the door in the closed position.

Figures 2, 2A, 4, 5, 6, 7, 10:
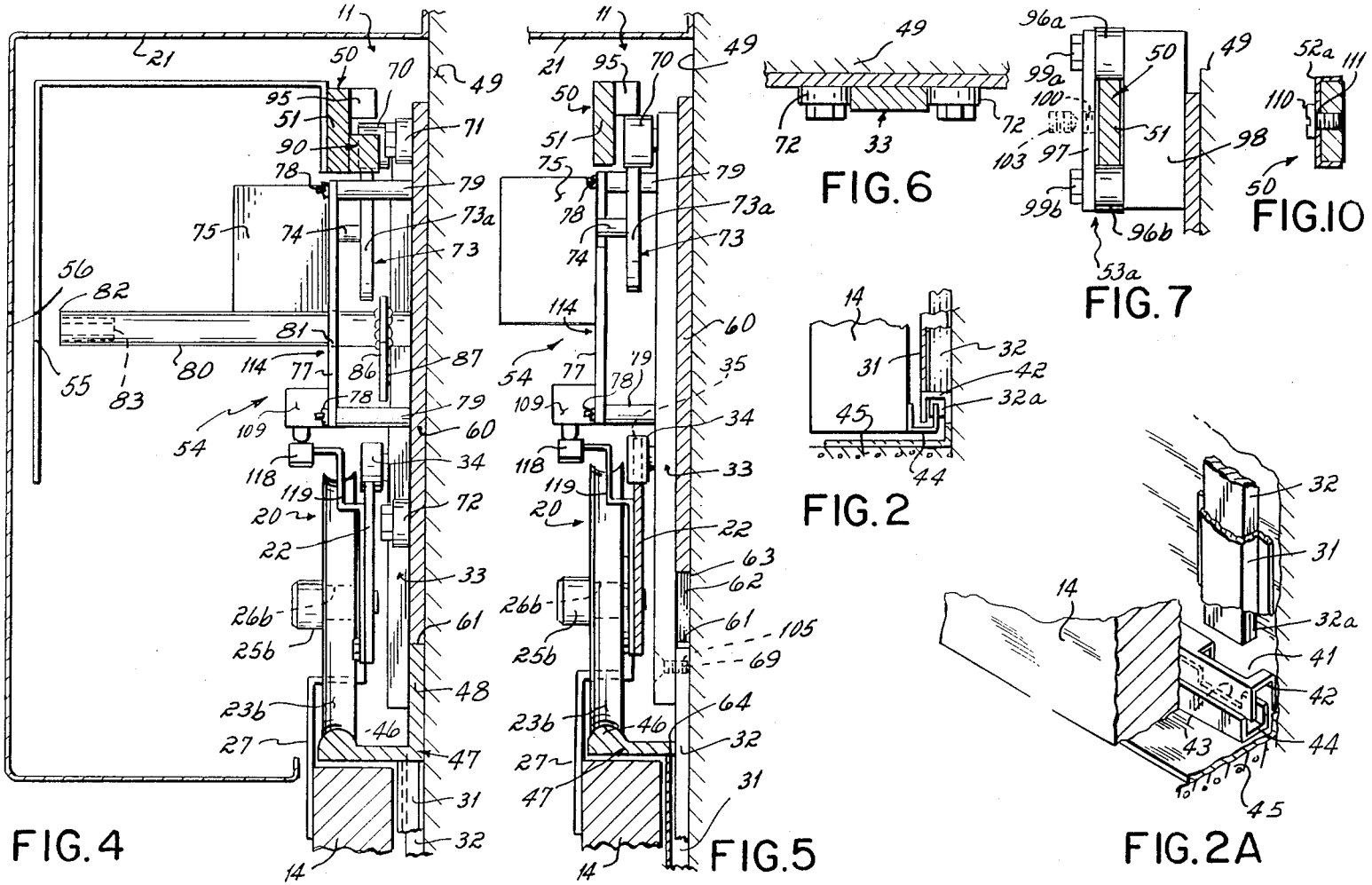
FIG. 2 is a cross sectional view taken along line 2—2 of FIG. 1.
FIG. 2A is a fragmentary, diagrammatic isometric view of a guide and lock bar latch at the base of the cell doors of the system of FIG. 1 and seen generally in the area of FIG. 2.
FIG. 4 is a cross-sectional view through the locking device along line 4—4 of FIG. 3.
FIG. 5 is a cross-sectional view through the locking device along line 5—5 of FIG. 3.
FIG. 6 is a cross-sectional view through the drop bar along line 6—6 of FIG. 3.
FIG. 7 is a cross-sectional view through the master bar along line 7—7 of FIG. 3.
FIG. 10 is a cross-sectional view through the master bar along line 10—10 of FIG. 1.

Referring to FIGS. 2 and 2A, when the door 14 is in the closed position, the lower end 32*a* of the lock bar 32, when the lock bar 32 is in its downward position, locks the lower end of the door 14 by extending through a hole 41 in a fixed rail 42. The rail 42 is an inverted "U" shape in cross-section and extends horizontally adjacent the bottom of the door 14, and into a notch 43 in the edge of moveable rail 44 on the door 14. The rail 44 is an upright "U" shape in cross-section and interlocks with the fixed rail 42 so that the door 14 is securely and slidably retained in position at its bottom edge just above the cell floor 45. A similar notch (not shown) is provided in the rail 44 so that the end 32*a* of the bar 32 will lock the bottom of the door 14 when the door is in the open position.

Referring again to FIG. 1, the door 14 is mounted so as to move in the transverse direction as shown in FIG. 1 with the roller bar assembly 20. The rollers 23*a*, 23*b* carry the roller bar assembly 20 in a reciprocating path as they rollably support the roller bar assembly 20 and also the door 14 by rollably contacting the upwardly facing semicircular convex top surface 46 of a roller track 47 with the downwardly facing concave semicircular lower points on the rollers 23*a*, 23*b*. The track 47 has an upwardly extending flange 48 by which the track 47 is welded or otherwise rigidly mounted to a transom plate 49 which is rigidly secured to the frame 18. The transom plate 49 is a rigid panel which extends horizontally along the front of the cells 11, 11' at a point immediately above the door openings 15, 15' and the cell walls 19, 19'. The rollers 23*a*, 23*b* support the roller bar assembly 20 so as to carry the door 14 between the door opened and door closed positions through reciprocatable movement along the rail 47. The brackets 37 and 40 are welded to the rail 47 to support the kicker spring assemblies 36 (FIG. 1) and 39 (FIG. 9), respectively.

Extending horizontally along the fronts of the cells 11 and 11' is a master bar or control bar assembly 50. The master bar assembly 50 is made up of a series of solid spliced sections 51 and 51', for example, joined together, according to certain features of the present invention by sections of longer, light weight hollow channel links including the link 52*a* which joins the sections 51 and 51'. The master bar 50, thus assembled, is positioned above, and parallel to, the rail 47 behind the transom plate cover 21 above the cell doors 14, 14'. The master bar 50 is mounted to slide horizontally and longitudinally on the transom plate 49 with brackets 53*a* and 53*b* which are carried by a door locking device 54 mounted to the transom plate 49 as will be described more fully below. The master control bar assembly 50 cooperates with, and in part controls, the operation of a door locking device 54 which in turn controls the motion of the lock bar 32 and lock bar head 33 between door locking and door unlocking positions.

As will be explained in connection with the description of FIGS. 9–16 below, the cell door locking and unlocking device 54 functions to unlock the doors 14 by raising the lock bar 32 and lock bar head 33. The lock bar 32 and lock bar head 33 are capable of being raised in three different ways by the device 54 in accordance with three of four possible positions of the master bar 50. In accordance with the fourth of these positions, all cells are dead locked.

The positions of the master bar 50 are best indicated by the positions of a shield 55 which is bolted at its upper end to the section 51 of the master bar 50 and movable longitudinally therewith. In the position shown in FIGS. 1 and 3, the device 54 is in an electrical control position set through the position shown of the master bar 50, a position in which the opening or unlocking of the door 14 is controlled through electrically actuated components of the device 54 which operate to selectively raise the lock bar 32 and lock bar head 33 so that the roller 34 is raised out of the notch **30*b*. When this occurs, the plunger 36*a* of the kicker spring assembly 36 is driven against the roller bar 22 by the force of the spring 36*b* to move the roller bar to the right in FIG. 1 causing the upper edge 35 of the roller bar 22 to move under the roller 34 holding the locking member in its unlocking position, with the door 14 remaining open a slight amount whereupon it can be manually advanced to either the fully open position shown in FIG. 9 or back to the fully closed position shown in FIG. 1**.

The position of the shield 55 in defining the electric position illustrated in FIG. 1 can be better shown with reference to the hidden lines to the left of the figure at cell 11'. In this position, the shield associated with cell 11', shield 55', is positioned to block a keyhole 56' in the transom plate cover 21 mechanically disabling the key actuated lock release mechanism which will be explained more fully below.

The construction of the locking device 54 can be better understood by reference to FIGS. 3–7. The device 54 includes a device support in the form of a device mounting plate 60 formed of a flat rectangular sheet of steel having a width of about 17" and a height of about 9". The mounting plate 60 has a lower edge 61 which rests on the upper edge of the flange 48 of the rail 47 when the device 54 is properly aligned vertically on the transom plate 49. In the lower edge 61 of the mounting plate 60 is a rectangular notch 62 into which the upper end of the drop bar 32 is inserted when the device 54 is properly aligned horizontally on the transom plate 49. The width of the notch 62 is approximately 1/16" greater than that of the drop bar 32. In the position shown in FIGS. 3–6, the drop bar 32 is in the lower locked position and accordingly there is a space 63 in the notch 62 above the upper end of the drop bar 32 to allow for vertical movement of the drop bar 32 in the notch 62. The drop bar 32 extends downward through a groove 64 in the flange 48 of the rail 47 and through the rail 47 into the lock post channel 31 which completely encloses the drop bar 32 from the rail 47 to the base of the door 14. The groove 64 is of width approximately equal to that of the notch 62.

The device mounting plate 60, thus positioned, is secured to the transom plate 49 of the cell 14 by a pair of horizontally spaced bolts **66*a* and 66*b* welded to and extending forwardly from the transom plate 49, through oversize holes 67*a* and 67*b* (FIG. 8), on which they are tightly secured by lock nuts 68*a* and 68*b***, respectively.

The drop bar head 33 is spliced at its lower end with machine screws 69 countersunk into the drop bar head 33 and threaded into the upper end of the drop bar 32. Rotatably attached to the forward face of the drop bar head 33 is the door locking roller 34 which, in the door closed and locked position, rests in the notch **30*b* of the roller bar 22. The roller 23*b* which is rotatably mounted on its axle 25*b* together with the roller 23*a* (not shown in these figures) supports the roller bar assembly 20 on the inverted track 46 of the rail 47. The door 14 hangs from the bracket 27 which is bolted by the bolts 28*a* and 28*b* at its upper end to the roller bar 22 and extends downwardly and around the rail 47 where it is welded to the upper edge of the door 14. The bracket 27 projects through a horizontal slot in the bottom of the transom plate cover 21 which encloses the device 54**.

At the upper end of the drop bar head 33 is rotatably attached a roller 70. The drop bar head 33 is slidably mounted to the mounting plate 60 and is constrained to move longitudinally in a vertical direction by two vertically spaced pairs 71 and 72 of horizontally spaced rollers rotatably mounted to the device mounting plate 60.

The roller 70 supports the drop bar head 33 against the downward force of its weight and the weight of the drop bar 32 by riding upon the upwardly facing surface **73*a* of a cam 73. The cam 73 is a rotatable cam mounted on a horizontal shaft 74 of the rotary cam actuating motor 75. The motor 75 is mounted upon an electrical component mounting plate 77 which is attached with lock nuts 78 to the bolt ends extending outwardly from each of three spacer posts 79 which are plug welded to the device mounting plate 60** and extend outwardly from the forwardly facing surface thereof.

A key release tube 80 is rotatably mounted to the forward face of the device mounting plate 60 and extends horizontally and forwardly therefrom through a guide hole 81 in the electric component mounting plate 77. The tube 80 has a forwardly facing end 82 with an axially aligned keyway 83 formed therein which in turn aligns with an access hole or keyhole 56 in the face of the transom plate cover 21. A lever 86 is rigidly secured to the tube 80 between the electric mounting plate 77 and the device mounting plate 60 and has its free end pivotally linked to the drop bar head 33 through a capped pivot pin 87 which slides in a slot 88 in the lever 86. As such, the lever 86 functions to raise and lower the drop bar head 33 and thus the drop bar 32 in response to the rotation of the key release tube 80. In the electric position shown in FIGS. 3–6, the shield 55 is positioned between the keyway 83 in the tube 80 and the access keyhole 56 thus making access to the tube 80 and the access to the keyway 83 of the tube 80 unavailable in this position.

The roller 70 is also positioned adjacent a wedge shaped linearly movable cam 90 rigidly secured to the back surface of the master bar section 51 of the master bar assembly 50. The cam 90 has an upwardly inclined ramp surface 91, a horizontal roller supporting surface 92 and a vertical stop surface 93. The cam 90 operates to lift the roller 70 and raise the drop bar head 33 to gang-open all of the cells simultaneously through operation of the master bar 50. This will be explained more fully in connection with the discussion of FIGS. 8–11 below.

A locking block 95 is similarly rigidly secured to the back of the master bar section 51 along the upper edge thereof and in alignment with the uppermost point on the surface of the roller 70 when the drop bar head 33 and the drop bar 32 are in their lowered or locking position. As such, the block 95, in cooperation with the roller 70 and the master bar 50, will operate to secure the locked condition of all of the cells and to lock out all other means for opening the cells through the operation of the master bar 50 to a dead-lock position. This position is described in connection with the discussion of FIG. 15 below.

The master bar assembly 50 is mounted across the transom plates 49 of all of the cells only through the brackets 53*a* and 53*b* on the device mounting plates 60 of each of the locking devices 54. As shown more fully in FIG. 7, the master bar assembly 50 is constrained between a pair of bushing spacers 96*a* and 96*b* in the vertical direction, and between mounting straps 97 and mounting blocks 98 in the horizontal direction perpendicular to plate 60. The block 98 is welded to the device mounting plate 60 at the upper edge thereof. The straps 97 are secured in spaced relationship maintained by the spacer bushings 96*a* and 96*b* on the block 98, through a pair of mounting bolts 99*a* and 99*b*, threaded into the block 98. A threaded hole 100 is provided through the center of the strap 97 which is adapted to receive a set screw for use in the initial assembly and alignment of the device 54 when installed within the system 10. This will be more fully explained in connection with the discussion of FIG. 8.

Figure 8:
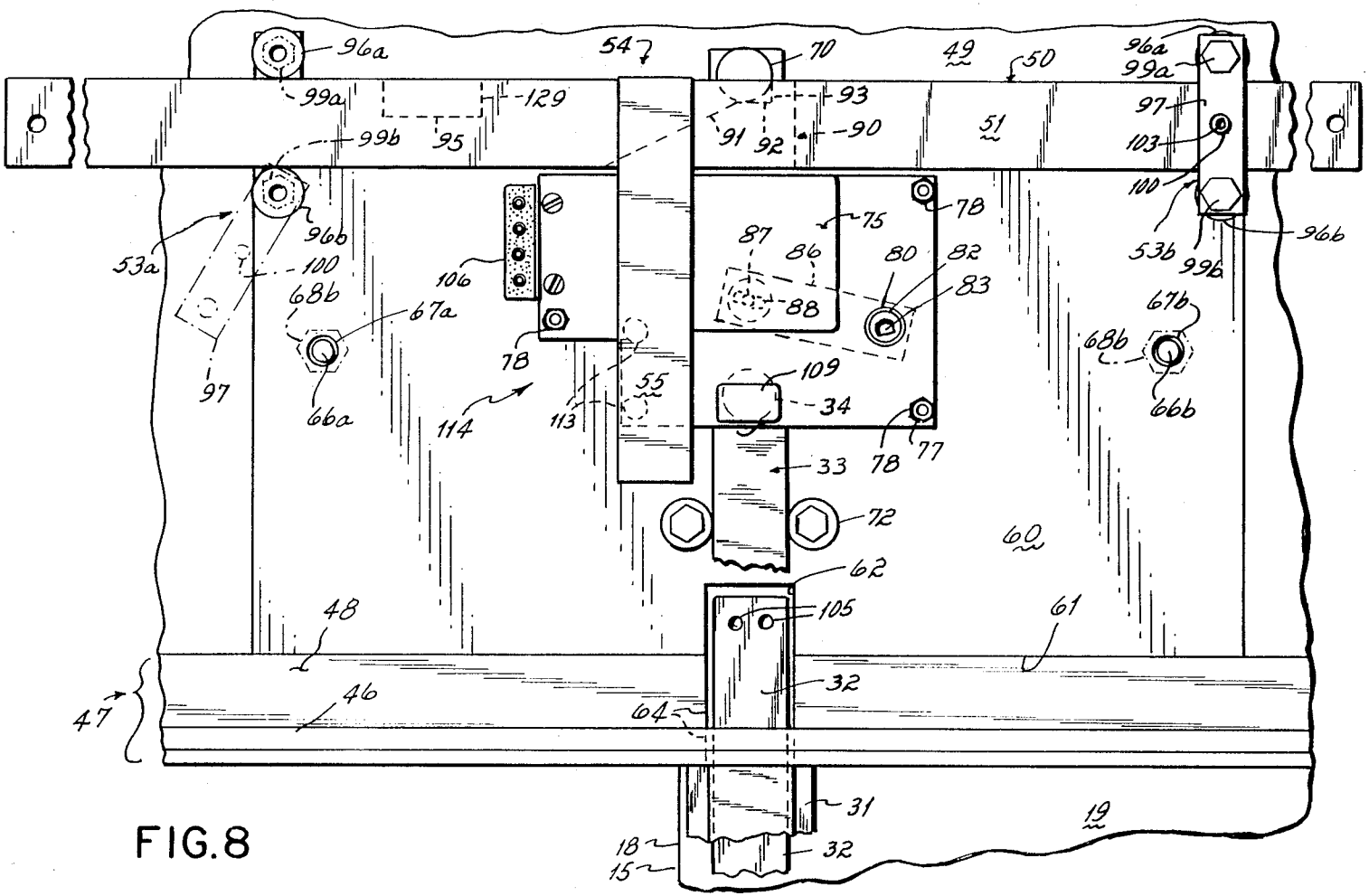
FIG. 8 is an elevational view of the device of FIG. 3, shown in the gang-open position and illustrating the installation of the device in a prison cell locking system.

FIG. 8 illustrates the concepts of the present invention which provide for the installation and assembly and subsequent repair of the locking device 54. As shown in FIG. 8, the locking device 54 is illustrated assembled with the components described above on the device mounting plate 60. A new unit of the locking device 54 is provided. A section of the master bar assembly 50 in the form of the linear section 51, approximately 3' in length, is of solid rectangular cross section. The sections 51 are provided with the cam 90 and the locking block 95 bolted or welded to the back surface thereof. The angled key hole shield 55 is similarly bolted or welded to the section 51 of the master bar 50 which is provided with the unit 54.

A unit 54, when new, is provided with the section 51 with the components 55, 90 and 95 attached and positioned in the brackets 53*a* and 53*b* such that the cam 90 is in the extreme leftmost position such that the roller 70 rests adjacent the surfaces 92 and 93 of the cam 90. Thus, the drop bar head 33 and drop bar 32 are expected to be in their unlocking position and the unit 54 set to the gang-open position at which the cell 11, as will all of the cells, is in the door unlocked state. So equipped for initial installation, the straps 97 of the brackets 53*a* and 53*b* will be tightly secured to the blocks 98 with the bolts 99*a* and 99*b* securely tightened. In addition, in each of the brackets 53*a* and 53*b*, a set screw 103 will be inserted in the holes 100 and tightened against the master bar section 51 to hold the section 51 in place. As so set for initial installation, both of the brackets 53*a* and 53*b* will be as illustrated in FIG. 8 in connection with the bracket 53*b*.

Figure 3:
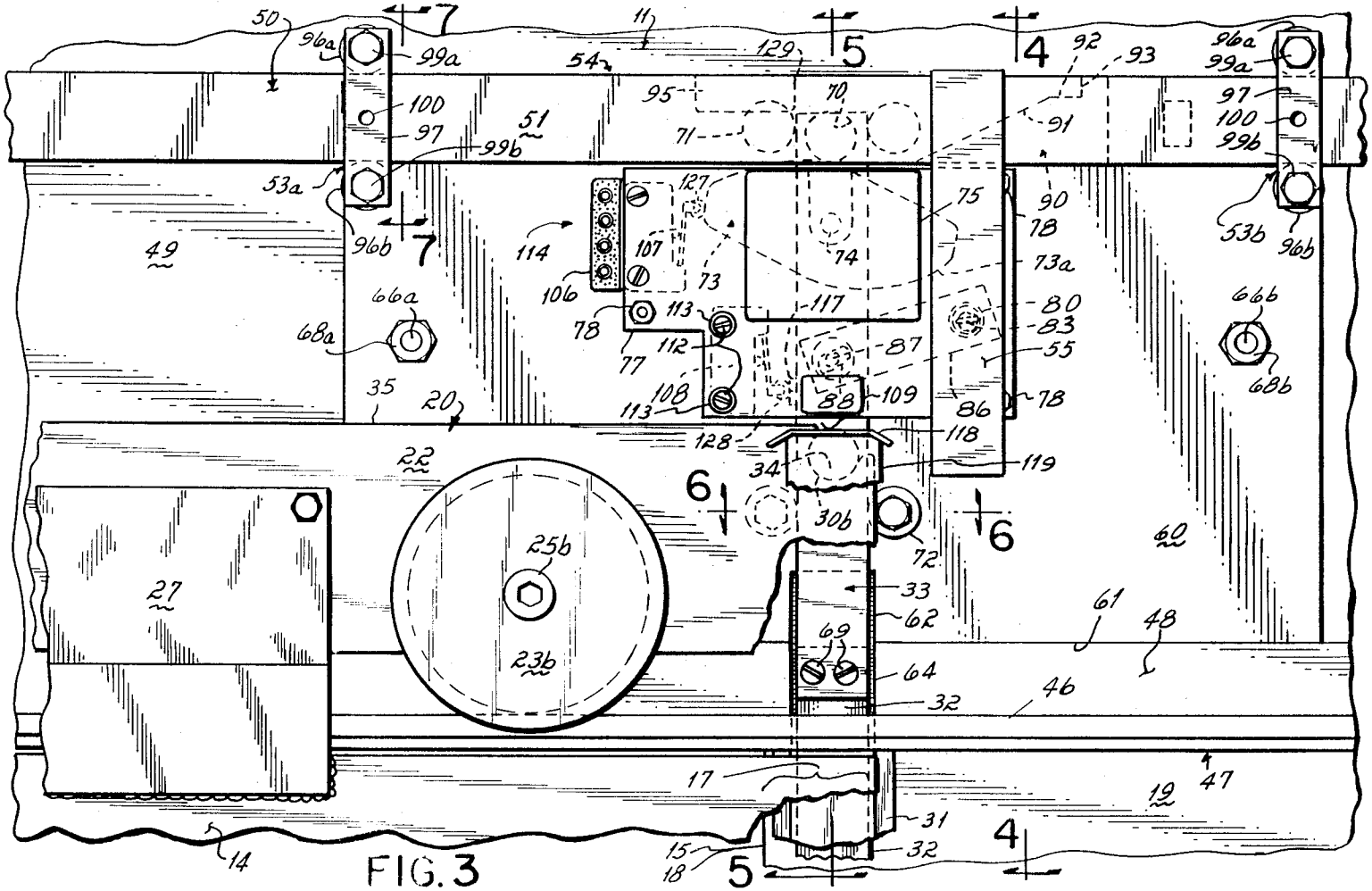
FIG. 3 is an elevational view partially broken away, of a portion of the door locking and unlocking system of FIG. 1 illustrating the cell door locking device of the one preferred embodiment of the present invention.

Equipped for initial installation, the drop bar head 33 will be in the raised position and ready for connection to the drop bar 32. The mounting device 54 so readied for installation, is installed by placing it against the transom plate 49 of a particular cell 11 such that the slot 62 in the device mounting plate 60 lies immediately above, and horizontally aligned with, the groove 64 in the rail flange 48 of the rail 47. The lower edge of the device mounting plate 60 is rested upon the upper edge of the flange 48 of the rail 47 thus vertically aligning the device 54 on the transom plate 49. In this position, the holes 67*a* and 67*b* in the mounting plate 60, which holes are oversized with respect to bolts 66*a* and 66*b*, will be easily positioned so as to surround the bolts 66*a* and 66*b*. So positioned, the mounting plate 60 is securely tightened to the transom plate 49 by tightening of the lock nuts 68*a* and 68*b*, respectively (FIG. 3). When the plate 60 has been secured to the transom plate 49, the drop bar head 33 is attached at its lower end to the drop bar 32 by raising the drop bar such that the threaded holes 105 provided in the drop bar 32 are aligned with matching holes in the drop bar head 33 to which they can be secured with the machine screws 69.

The accurate positioning of the plate 60 on the rail 48 may be facilitated by the use of a key having the same thickness as the drop bar 32 but of approximately 1/16" greater width to fill and align the notch 62 with the groove 64 in the flange 48 of the rail 47.

The device 54 is a complete unit containing in addition to the mechanical components described above, an electrical connector 106 secured to the side of motor mounting plate 77, a pair of lock position limit switches 107 and 108 secured to the plates 77 and 60, respectively, a closed door limit switch 109 secured to the face of the motor mounting plate 77, and wiring for the limit switches 107, 108 and 109 and the motor 75, all as will be described more fully below.

When the installation of the unit is complete, the master bar section 51 is then connected in line with similar components of the master bar assembly 50 through the use of the long channel shaped linking bars 52*a* as are more particularly shown in FIGS. 9 and 10. Referring to FIG. 9, the master bar 50 is shown with the solid section 51 connected by channels 52*a* and 52*b*. Upon initial installation, when the unit 54 has been installed as described in connection with FIG. 8 above, the channel links 52*a* and 52*b* are connected with screws 110 through longitudinal slots 111 in the shorter master bar sections 51. Thus, the lengths of the links 52*a* and 52*b* can be adjusted to properly position the solid member 51 at the correct position on the master bar assembly 50. When this has been done, the screws 110 are tightened on the channels 52*a* and 52*b*. The channels may be then tack welded at their ends to the ends of the adjacent master bar section 51. At this point, the set screws 103 are removed from the straps 97 and the master bar 50 is then free to move with respect to the device 54. The long, lighter weight links 52*a*, are of larger cross sectional dimensions than the sections 51 as shown in FIG. 10. The channels are supported only on the section 51

Once the master bar has been so assembled, the device 54 is still easily removable for service or replacement. The master bar section 51 may be left in place to avoid having to readjust it, as will be the case if it has been welded to the channels 52*a* and 52*b*. This can be done by loosening the straps 97 by removal of the bolts 99*a* and the nuts 68*a* and 68*b*, disconnecting the drop bar head 33 from the drop bar by removal of the screws 69 unplugging a wire harness (not shown) from the connector 106 and then removing the entire device 54 from the system for service or replacement. The master bar section 51, if it was permanently welded into the master bar assembly 50, thus need not be removed with the device 54 for subsequent repair.

Similarly, portions of the device 54 may easily be removed for service. For example, the electrical component mounting plate 77 can be detached and removed with the electrical components then being removed or exposed so that electrical maintenance may be performed on the device 54. Removal of the entire electrical assembly is easily accomplished by first loosening two screws 112 with a screw driver inserted through access holes 113 to loosen the microswitch 108 from plate 60. Then removal of the three nuts 78 will remove the entire electrical portion 114 of the device 54. The wiring to connector 106 is of a suitable length to permit the assembly 114 to pivot about key-lock post 80 when the assembly has been freed from spacer posts 79. In addition, others of the mechanical components may be similarly replaced in that they are all easily accessible once the transom plate cover 21 is removed.

The installation of the device 54 with the master bar 50 in the gang-open position allows the placement of the device 54 in behind the roller bar 22 with the roller 34 positioned above the upper edge 35 of the roller bar 22. Accordingly, the door 14 may be in an unlocked state with the roller bar 22 positioned along the rail 47 in any position. Since the door 14 is unlocked as a locking device 54 is being installed, the kicker springs at the opposite ends of the track of the door 14 will keep the roller bar 22 positioned such that the edge 35 underlies the roller 34 and that neither of the notches **30*a* or 30*b* will be directly beneath the roller 34. This is shown in FIG. 9**.

Also, as seen in FIG. 9, the links **52*a* and 52*b* will be somewhat longer than the section 51 of the master bar 50, but not substantially so. The channel links 52*a* and 52*b* will more specifically be approximately 5' in length with the bar 51 being approximately 3' in length, each of the components 51, 52*a* and 52*b* having an additional few inches in length to provide for the overlap connection between them. As such, each of the units 54 can be packaged with relatively compact components and each module can be assembled in typical 8' jail cells 11**.

The operation of the device 54 can be better understood by reference to the various positions shown in FIGS. 11–16.

The four positions controlled by the longitudinal placement of the master bar assembly 50 are as follows: first, the leftmost master bar position is the gang-open position in which all of the cell doors in the row of cells are unlocked. The gang-open position is that illustrated by the position of the system components in FIGS. 8, 9 and 11. In this position the master bar 50 is moved to its extreme left position as shown in the most detail in FIG. 11. As the master bar 50 is moved to the left approaching this position, the sloped wedge surface 91 of the cam 90 wedges beneath and lifts the roller 70 lifting the drop bar head 33 upward and bringing the roller 34 upward with the drop bar 33 to allow the roller bar 22, and thus the roller assembly 20 and the door 14 carried by the roller bar assembly 20, to move freely as the rollers **23*a*, 23*b* roll freely on the track 46 of the rail 47. The raising of the drop bar head 33 also raises the drop bar 32, lifting its lower end 32*a* from the notch 43 in the rail 44 at the base of the door 14 as was explained in connection with the description of FIGS. 2 and 2A. Accordingly, the door 14 is free to be moved by the prisoner or a guard, and cannot otherwise be locked through the use of the locking device 54. The vertical surface 93 of the cam 90 defines the leftmost position of the master bar assembly 50 as it positively engages the roller 70. The horizontal surface 92 of the cam 90 supports the lock bar head 33 and lock bar 32** in the unlocked state when the master bar is in this position.

Figure 11:
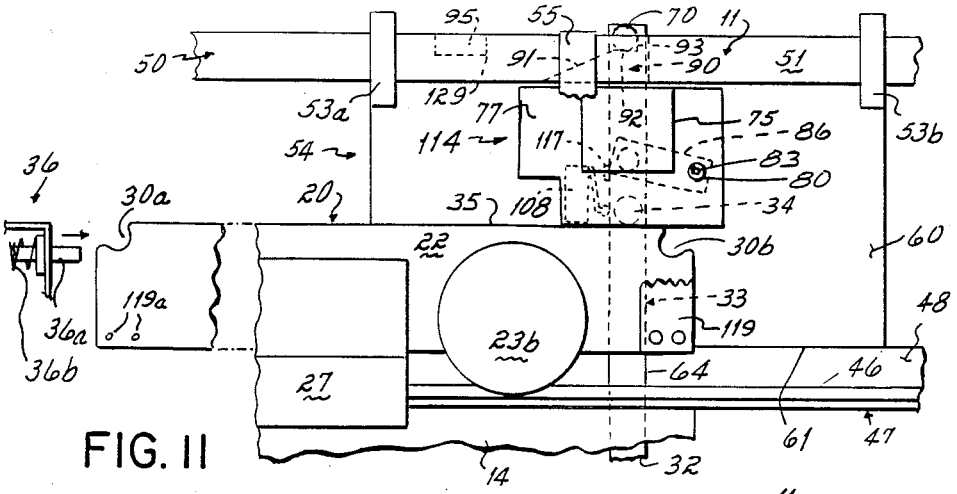
FIG. 11 is an elevational view of a portion of the locking device of FIG. 3, partially broken away and partially in cross-section with the locking device in the gang-open position as in FIG. 9.

As the master bar 50 moves to the right from the gang-open position shown in FIG. 11 the roller 70 slides down the ramp cam surface 91 under the weight of the drop bar head 33 and drop bar 32 until the roller 34 rests on the upper surface 35 of the roller bar 22.

When the cam 90 has moved completely from under the roller 70, it will be possible for the drop bar head 33 to descend further to lock the door 14. For this to be possible, however, the door 14 will have to be moved manually, usually by the prisoner, to urge it either against the door closed kick spring assembly 36 (FIG. 1) or the door open kick spring assembly 40 (FIG. 9). The drop bar 32 and drop bar head 33 together with the roller 34 will descend such that the roller is in one of the two roller bar notches **30*a*, 30*b* to lock the door in either the door closed or door opened positions as shown in FIGS. 3 and 12, respectively. In either position, as for example in the door open position as shown in FIG. 12, the roller 34 drops into the notch, for example notch 30*a* where it functions to lock the door open. When the door is locked in either such position, a small cam 117 on the side of the drop bar head 33 activates the microswitch 108 so that it can be monitored in a control booth that the particular cell door associated with cell 14** is locked in either the open or closed position.

Figure 17:
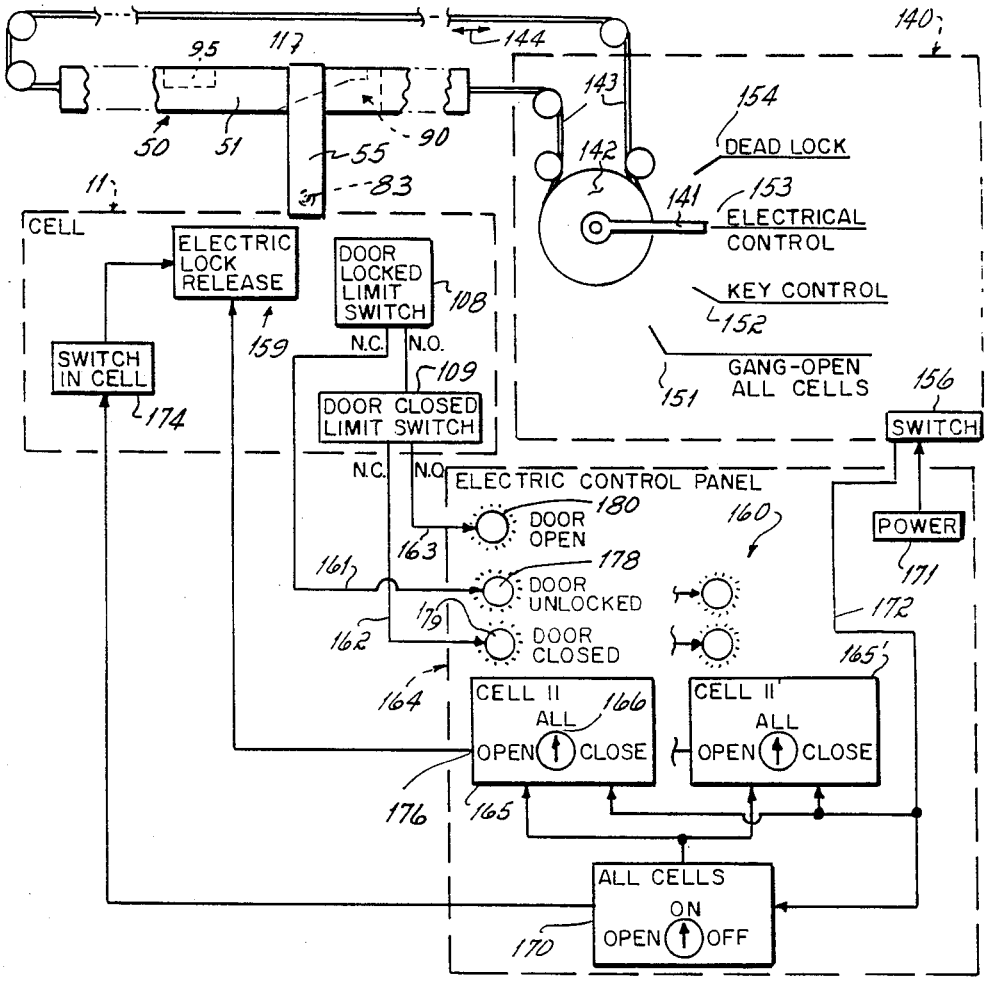
FIG. 17 is a schematic diagram of the control portion of the system of FIG. 1.

To distinguish between the locked open and locked closed position of the door, the limit switch 109 is connected, as shown in FIG. 17. Switch 109 is activated by the cam 118 of a cam bracket 119 mounted on the roller bar 22 as shown in FIGS. 4 and 5. Both the switch 109 and the arm 118 of bracket 119 are mounted so as to be in alignment with the lock bar 32 when the door 14 is locked closed (FIG. 3). As such, the switch 109 is symmetrically mounted to function from the same position on the plate 77 for either right or left handed doors (to be described). The cam bracket 119 is mountable in predrilled holes **119*a* adjacent either notch 30*b* (as shown in FIG. 1) or 30*a*** for right and left opening doors, respectively.

As the master bar 50 is moved to the right of FIG. 11, it first passes through the second position which is the key position illustrated in FIG. 12. Before describing the key position in detail, however, the third position, the electrical control position shown in FIGS. 1, 3 and 13 will be described. The electrical control position is the normal operating position of the system 10.

Figure 12A:
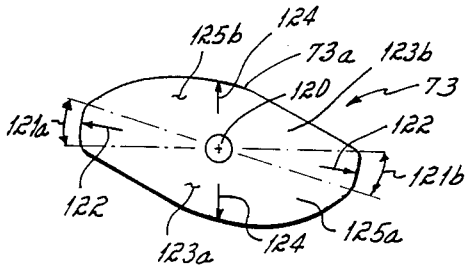
FIG. 12A is a plan view of the cam associated with the electric opening means of the device of FIG. 3.
Figure 13:
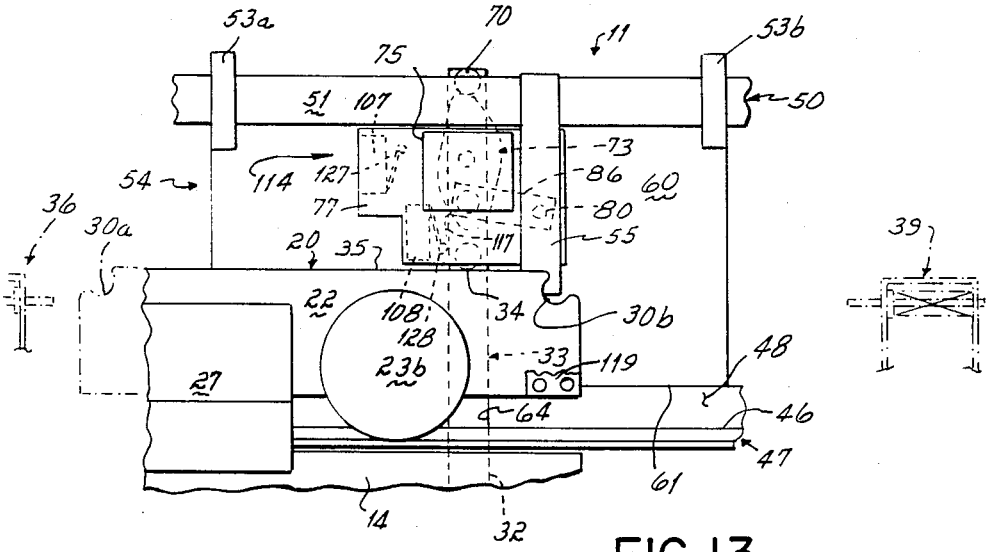
FIG. 13 is a view similar to FIG. 12 with the master bar in the electrical control position and showing the electric unlocking feature in the process of unlocking the door.

Referring to FIG. 13, as with FIGS. 1 and 3, the master bar 50 is positioned such that the shield 55 blocks the access to the key release tube 80. In this position of the master bar 50, the only unlocking of the cell door is accomplished through an activation of the electrical door opening mechanism by activation of the motor 75 (FIG. 3). Operation of the motor 75 activates the cam 73 rotating it through 180°. The rest position of the cam 73 is that shown in FIG. 12. The cam 73 is illustrated in more detail in FIG. 12A.

Referring to FIG. 12A, the cam 73 has an axis 120 which is aligned with the shaft 74 of the motor 75 (FIG. 3). The cam 73 is intended to rotate clockwise in the figures. The cam 73 has a cam surface which may be divided into two halves, each of 180°, and each having identical cam surfaces, the surface being symmetrical on every diameter thereof, and each divided into three sections. The first section **121*a* and 121*b* of each half has a surface which is circular about the axis 120 at a radius 122. This radius 122 represents the distance between the axis 120, which is also the axis of the shaft 74 of the motor 75 (FIGS. 4 and 5) and the lowermost point on the edge of the roller 70 when the drop bar head 33 is in the raised position as shown in FIG. 11 where it is in contact with the cam surface 92 of the cam 90. It also is the distance between the axis 120 and the activated position of the switch 107 as shown when the cam is in the position of FIG. 12. A second section of the cam surface is the segment 123***a* and 123*b*. In this region, the cam surface is approximately linear and connects radius 122, the major radius of the cam with a radius 124 which is a minor cam radius. The third segment of the cam 125*a*, 125*b* is also a section of a circular curve which joins the radius 124 with the radius 122.

Referring now to FIG. 13, the master bar 50 in the electrical control position sets the system 10 so that only actuation of the cam 73 will elevate the roller 70 and the drop bar head 33 and drop bar 32.

As shown in FIG. 12, the roller bar 22 is in the extreme right position with the door 14 open, and engages the kick spring 39. It is held in this position by the roller 34 which is seated in the notch 30*a* of the roller bar 22. The roller 70 is resting on the surface of the cam 73 at a distance 124 from the cam axis 120. Additionally, a cam follower 127 of the limit switch 107 rides on the surface of the cam 73 at a radius 122 from the cam axis 120 in the region 121*a* or 121*b* of the cam 73.

The switch 107 is a normally closed switch which is actuated in the position shown in FIG. 12 so that its contacts are open. It is connected in series with the power to the motor 75 (FIGS. 3–5) so that no power is being applied to the motor and the cam 73 is stationary. Control circuitry is wired so as to parallel the switch 107 when actuated. A control signal is applied to open the door lock by applying power to the motor in parallel to the switch 107 thus causing the cam 73 to rotate in the clockwise direction. As this occurs, the roller 70 rolls from a point on the surface of the cam at the juncture of region 123*b* with region 125*b*, at a radius 124 from the axis 120 through the region 125*b* to a radius 122 in the region 121*a* of the cam surface as illustrated in the drawing of FIG. 13.

As will be seen in FIG. 13, the roller 70 has been lifted to its upper position at which it was in FIG. 11, lifting the drop bar head 33 and the drop bar 32, raising the roller 34 out of the notch 30*a* and the foot of the drop bar 32*a* (FIG. 2) out of the notch 43 in the rail 44, unlocking the door 14 and causing it to be pushed, in this case towards the closed position, by the kicker spring 39. This causes the roller 34 to be suspended above the upper edge 35 of the roller bar 22. As the cam 73 continues to rotate, the portion of the cam surface in contact with the roller 70 moves into the region 123*a*. This causes the cam 73 to release the roller 70 to allow the drop head 33 to drop downward until the roller 34 rests upon the upper edge 35 of the roller bar 22. At this point, the door 14 of the cell 11 will have been unlocked and can then be pushed to either its fully open or closed position. The cam 73 will, however, continue to rotate in that now the arm 127 of the limit switch 107 has been released by the cam causing the normally closed switch to continue to energize the motor which drives cam 73. The cam will then continue to circulate clockwise until the cam surface region 121*b* contacts the cam follower arm 127 again opening the switch 107 breaking the power to the motor 75. The region 121*b* is sufficiently large so as to allow the motor to come to a complete stop without releasing the cam follower arm 127 of the switch 107.

Figure 14:
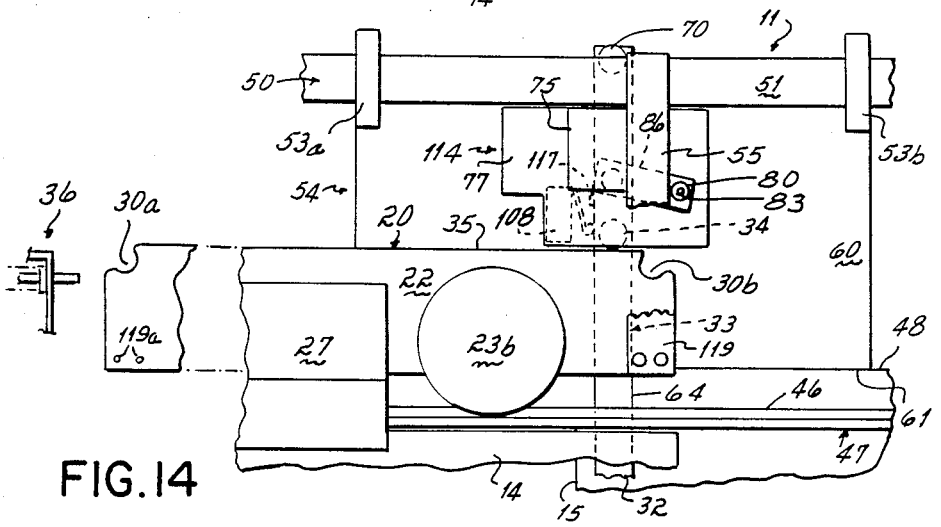
FIG. 14 is a view similar to FIG. 11 with the master bar in the key position and with the door unlocked.

The key position of the master bar 50 is shown in FIG. 12 and 14. There, the shield 55 is to the left of the key release tube 80, thus allowing access by for example a guard, with a key tool or wrench for manually opening the cell 11. As shown in FIG. 14, the key lever 86 is shown pivoted clockwise about the key release tube 80 following the manual release of the clock with the tool in the keyway 83 of the tube 80. As with the raising of the drop bar head 33 with the cam 73, raising of the drop bar through the activation of the lever 86 has the same effect of lifting the drop bar head 33 and thus the roller 34 out of whichever one of the notches 30*a* or 30*b* in which it was engaged. The roller bar 22 will have been pushed away from the respective open or closed position by the kicker spring at that location and the roller 34 will be resting on the upper surface 35 of the bar 22. As can be seen, as will also be the case when the door has been released in any other manner, the switch 108 will have its control arm 128 fall off of the cam surface 117 thus changing the state of switch 108 so that it can be determined in the control room that the door 14 of cell 11 is unlocked.

Figure 15:
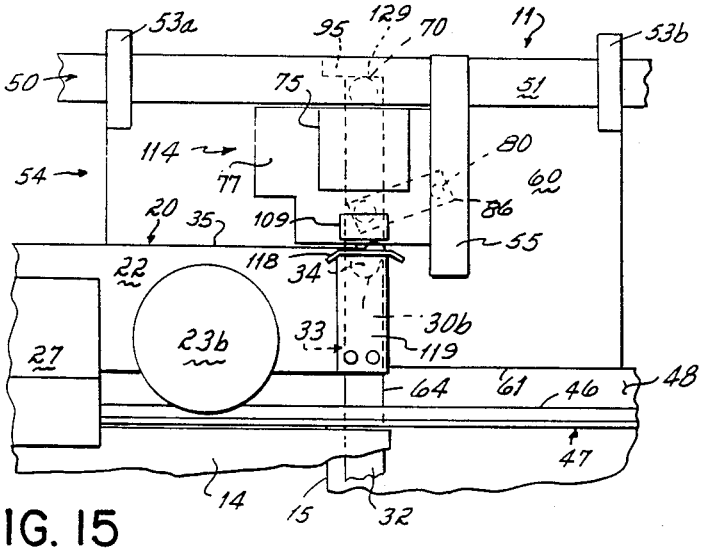
FIG. 15 is a view similar to FIG. 11 showing the master bar in the dead lock position and the door locked closed.

FIG. 15 illustrates the dead lock position which is the extreme rightmost position of the master bar assembly 50. In this position, the keyway 83 of the key release tube 80 may be still blocked by the shield 55 but more importantly the block 95 on the master bar assembly 50 will be positioned above the roller 70 thus preventing raising the drop bar head 33 and thus the drop bar 32 and the drop bar roller 34. Therefore, in the dead lock position, the doors will remain in a locked state. It should be noted that only when all of the doors in a row are completely locked will it be possible to move the master bar 50 to the dead lock position in that the roller 70, when any cell is unlocked, will be in a raised position in the path of the vertical leading edge 129 of the block 95.

Figure 16:
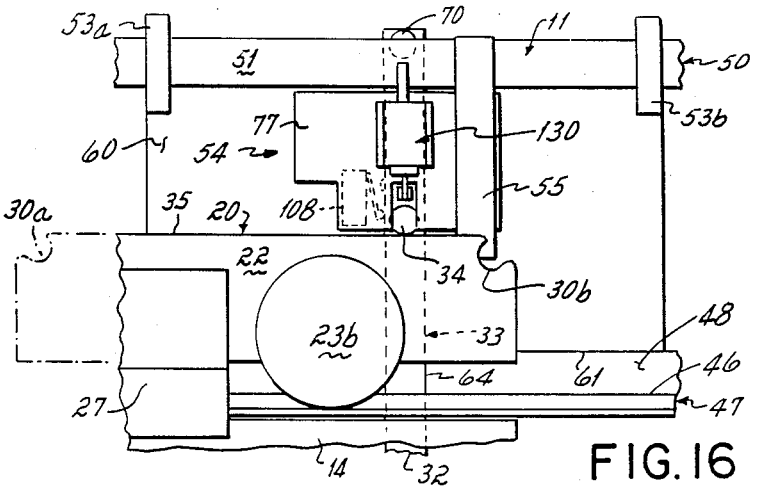
FIG. 16 is a drawing similar to FIG. 13 showing an alternative embodiment of the present invention.

FIG. 16 shows an alternative to the rotary cam embodiment described above in connection with FIGS. 3, 4, 12 and 13. In the embodiment of FIG. 16, replacing the rotary motor 75 of FIGS. 4 and 5 and the cam 73 of FIGS. 4, 5, 12 and 13 with a linearly acting solenoid 130, the drop bar head 33 will be directly moved vertically when the solenoid is activated to lift the drop bar and unlock the door. In this embodiment, the solenoid 130 is the electric motive means which, like the electric rotary motor 75, is secured to and fixed on the device 54. Its output is a linear actuator shaft which is pinned to the master bar head 33 to move it vertically.

With either embodiment, the control circuit shown in FIG. 17 can be used to operate the system 10. The control system of FIG. 17 is typical of control systems for locking systems of the prior art. A manual master bar control cabinet 140 will contain a master bar operating lever 141. Usually, one master bar control cabinet 140 is located at the end of each cell row 13. Sometimes they are, however, linked together. This is a purely mechanical mechanism in most applications so that it can operate without electrical power. It is designed such that the lever 141 will for example turn a pulley 142 which will move a cable 143 to translate the rotary motion of the pulley 142 into linear motion in the horizontal direction shown by reciprocating arrow 144 for the master bar assembly 50.

The lever 141 is shown in the normal operating mode, the electrical control position of FIGS. 1 and 13. It is movable to the gang-open position 151 at which the master bar assembly 50 would be in the extreme left position as shown in FIG. 11, then to the key position 152 where the system will be operable only under the manual operation by a guard at the cell as illustrated in FIG. 14 to the electrical position 153 and then to the dead lock position 154 illustrated in FIG. 15.

The deadlock position is used when it is necessary to lock all of the cells and to prevent all means of selectively or simultaneously opening any of the cells. This may be used in cases of emergency such as rioting or other such condition wherein the prison operators wish to lock all the cells. The gang-open position 151 is a condition which will allow for the mechanical releasing of all of the cell locks in situation of other emergencies such as fire or other conditions requiring or justifying the opening of all of the cells. The key control position 152 is used in those situations where the cells may have been all locked such as at night and it is necessary for a guard to proceed to a cell 11 and determine whether at the cell the cell door 14 should be unlocked. In the gang-open position 151, the key control position 152 or the dead lock position 154, the electrical controls are disabled.

The electrical controls are only enabled when the lever 141 is in the electrical control position 153. In that case, a switch 156 will be closed connecting power to the electrical control system 160. In the system 160, the electrical lock release 159, which may take the form of either the motor 75 or the solenoid 130 in FIG. 16, is illustrated in block diagram form. The limit switch 108 is provided in each cell locking device 54 to determine the locked condition of the drop bar. Also, the limit switch 109 is provided in each cell to tell whether or not the door to the cell is closed. These switches 108 and 109 transmit electrical signals along wires 161, 162 and 163 to a control cabinet 164.

Limit switches 108 and 109 both each have a normally open and a normally closed contact and a common terminal. The common terminal of switch 108 is energized. Line 161 is connected to the normally closed contact of switch 108 and is thus energized when the door is unlocked. The common terminal of limit switch 109 is connected to the normally open contact of limit switch 108 and is thus energized only when the door is locked. Line 162 is connected to the normally open contact of switch 109 and is energized when the door is locked and closed. Line 163 is connected to the normally closed contact of switch 109 and is energized when the door is both locked and closed.

In the control room or cabinet 164, a control panel is provided At the control panel there is for each cell a switch operable to set the cells to simultaneous control in what is called the all cell position 166. This all cell position 166 is one at which the switch 165 is normally connected. When in this position, the cell will operate in unison with all other cells similarly connected through the operation of an all cell lock control switch 170. The switch 170, when in the on position as shown in FIG. 17 connects power from a power source 171 through the switch 156 and the lines 172 through the switch 170 and to apply energy through each of the switches 165, 165', etc. which are set to the all position. When the switch 170 is switched to the open position, the power is then applied through the switch 170 to all of the cells thus opening all of the locks simultaneously by energizing all of the lock release devices 159 (motors 75 or solenoids 130). The switch 170 may also have a position to energize switches within the cells such as switch 174 to allow the prisoner to selectively open his own cell from the inside under certain conditions. Such a switch 174 may include two switches in parallel, one a push button switch operable from within the cell and the other a key operated switch in the door accessible from the outside by the prisoner assigned to the cell.

The switch 170 also has an off position. When in this position, none of the electrical controls actuating the openers of any of the cells may be operated. While in the on position, each of the switches 165 may be selectively operated to open cell doors selectively by turning the switch 165 to the open position 176. When the switch 165 is in the open position which is a momentary position, the electric lock release will be actuated and the cell door will open. When any of the switches 165, 165' or 170 is turned to the open position, it will momentarily make contact to energize the lock release and then return to the on position on the switch or the all position in the case of switches 165. Furthermore, any one of the switches 165 may be moved to the closed position. When in this position, the selected switch will not respond to the all open command of switch 170, thus allowing for cells to be selectively set to remain in the locked position while the other cells are operated.

The line 161 from switch 108 is connected to a door unlock indicator light 178 for the respective cell 11 so that the operator in the control booth can tell from an indicator light 178 on the panel that a particular cell door relating to cell 11 is unlocked. Similarly, an output line 162 from the normally open contact of the door closed limit switch 109 is also connected to the panel and will illuminate a door closed panel light 179 on the panel associated with the particular cell 11. The output line 163 from the normally closed contact of limit switch 109 is connected to the panel so as to illuminate a door open limit switch 180 on the panel associated with the particular cell 11. A set of the lights 178–180 is provided for each cell 11.

Figure 18A:
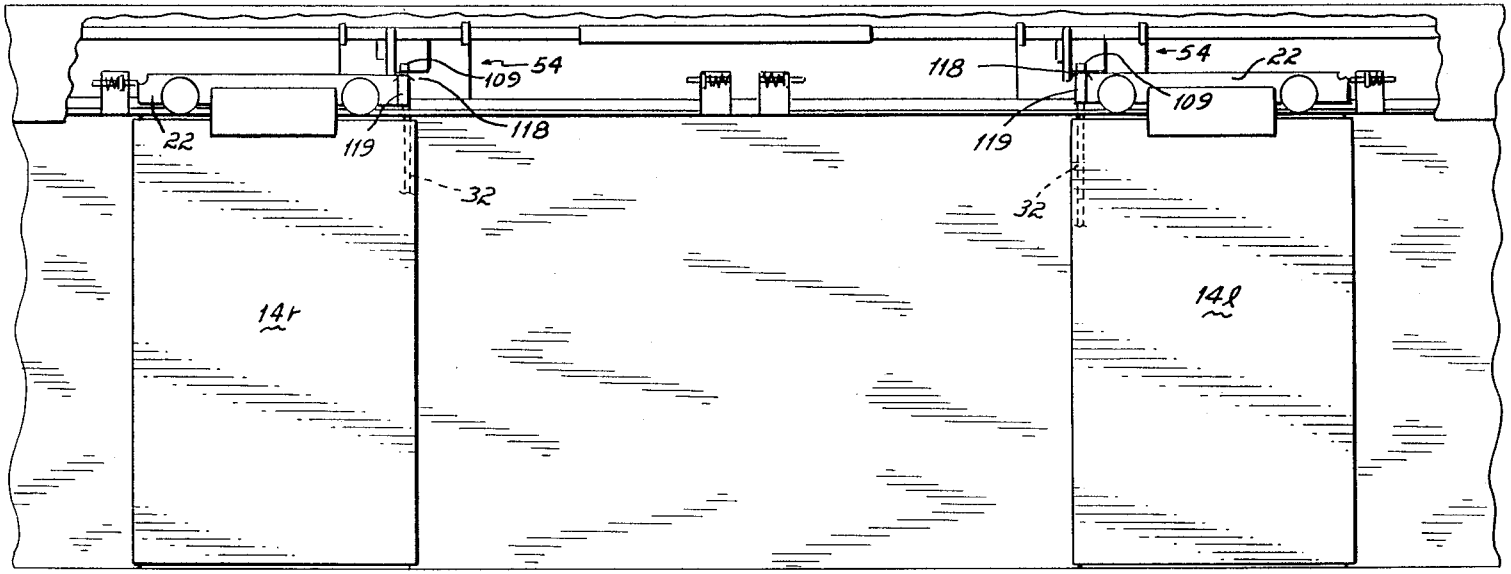
FIG. 18A is a drawing similar to FIG. 1 showing an installed locking device in both left and right opening doors, with the doors shown in the locked closed positions.
Figure 18B:
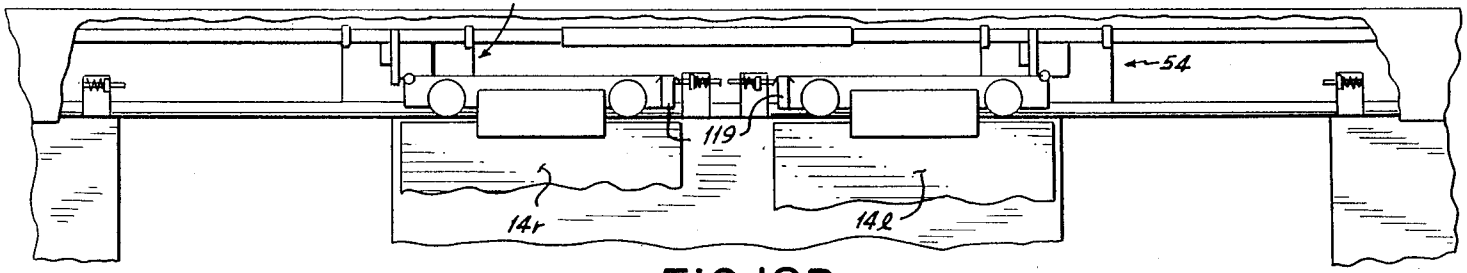
FIG. 18B is a drawing similar to FIG. 18A with the doors in their locked open positions.

Referring to FIGS. 18A and 18B, certain features of the present invention which give the locking device 54 a capability of being installed without modification for both left and right opening cell doors 141 and 14r. Because the device 54 is compact and operates in line with the drop bar 32, or in the plane of the drop bar, identical units will effectively service both cell doors opening to the right or left. Where the door is designed to lock in both its open and closed positions, however, the cam bracket 119 and microswitch 109 are employed to distinguish between lock open and lock closed. Thus, the cam bracket 119 need be installed on the end of the roller bar 22 which enables the cam 118 thereon to activate switch 109 when the door is locked closed. This end is opposite for left and right opening doors Having described the invention, what is claimed is:

1. A prison cell door locking system for controlling the door locks of a plurality of cells arranged in at least one row, wherein the cell of the row has a cell frame, said system comprising:

a plurality of cell door locking and unlocking devices, one at each cell of said row;

a central control location;

a longitudinally movable master control bar assembly operable from said control location and extending horizontally along each cell of the row for simultaneously controlling the operation of said cell door locking and unlocking devices at each of the cells of the row;

said master bar assembly including a plurality of horizontal master bar sections, one at each of said devices and operatively linked thereto and slidably mounted on to said frame; and, said master bar assembly further including a floating horizontal master bar link rigidly connected at each end to the ends of adjacent master bar sections of the cell door locking and unlocking devices of adjacent cells;

said master bar section being shorter than said master bar link; and said master bar link being a hollow light weight channel with external cross-sectional dimensions greater than those of said master bar sections.

2. An assembled cell door locking and unlocking device installable in a prison cell system having a plurality of cells arranged in at least one row, wherein each of said cells has a cell frame, door hanging means mounted to the frame for mounting a cell door for movement with respect to the frame between an open position and a closed position, wherein the cell door has locking means at least partially carried by and movable with the door which, when the door is mounted on the frame, cooperates with a movable locking member of a locking device supported on and secured to the frame to lock the door against motion with respect to the frame when the locking means is engaged by the locking member, and to release the door for movement with respect to the frame when the locking means is disengaged by the locking member, and wherein the system has a central control location and a longitudinally movable master control bar assembly operable from the control location and extending horizontally along each cell of the row for simultaneously controlling the operation of the cell door locking and unlocking devices at each of the cells of the row, said device comprising:

a mounting support for removably supporting said assembled device on the frame;

means on said support for aligning said support at a predetermined position and orientation on the frame;

means on said support for securing said support to the cell frame when aligned thereon;

the locking member mounted to said support and movable thereon between a door locking position and a door unlocking position, said locking member being aligned, when said support is aligned and supported on the frame, to engage the locking means of the cell door when said member is in its locking position and the door is in its closed position to lock the door in its closed position, and to disengage the locking means when said locking member is in its unlocking position to unlock the door;

key responsive lock operating means carried by said support and accessible from adjacent said support for selectively moving said locking member to its unlocking position;

electrically actuatable lock operating means carried by said support and electrically connectable to the control location so as to be, when enabled, remotely operable from said control location to selectively move said locking member to its unlocking position in response to a signal from the control location;

a horizontal master bar section slidably mounted on said support and selectively movable to any one of a plurality of bar positions, said bar positions including a door release position, and at least one lock operating position, release means partially carried by said master bar section and partially carried by said locking member to move said locking member to its unlocking position when said section is in its release position, and to permit movement of said locking member to its locking position, and from its locking position to its unlocking position by at least one of said lock operating means when said section is in its lock operating position; and, a horizontal master bar link rigidly connectable between said master bar section and a master bar section of a cell door locking and unlocking device of an adjacent cell in the row for rigidly connecting said master bar section into the master control bar assembly.

3. The device of claim 1 wherein said door hanging means includes means for slidably mounting said door on the frame including a horizontal rail rigidly mounted to the frame having an upwardly facing edge, and further comprises:

a horizontal bar rigidly secured to the door;

a pair of horizontally spaced rollers rotatably attached to said horizontal bar and supported in rolling engagement on the edge of the rail to slidably hand the door on the frame; and said locking member has latching means to immobilize said door mounted thereto; and the locking means includes a first notch in said bar and located therein to be engaged by said latching means when said locking member is in its locking position and the door is in its closed position.

4. The device of claim 3 wherein the locking means further comprises:

a second notch in said horizontal bar and located therein to be engaged by said latching means when said locking member is in its locking position and the door is in its open position.

5. The device of claim 3 wherein:

said horizontal bar has an upper horizontal edge;

said latching means includes a roller rotatably mounted on said locking member; and said notch is in the form of a step in said edge of said horizontal bar, said latching means being in rolling engagement with said edge of said horizontal bar when said door is unlocked and neither in its open nor its closed positions.

6. The device of claim 3 wherein the locking member includes a vertical lock bar mounted and vertically slidable on the frame, and:

said means for aligning includes means for horizontally aligning said locking member with the lock bar and for vertically aligning said support with the rail; and said means for securing includes means for rigidly connecting said locking member to the lock bar.

7. The device of claim 1 wherein the locking member includes a lock bar slidably mounted in the frame, and:

said means for aligning includes means for aligning said locking member with the lock bar; and said means for securing includes means for rigidly connecting said locking member to the lock bar

8. The device of claim 1 wherein said key responsive lock operating means comprises a rod pivotally mounted on said support and linked to said locking member to move said locking member between its locking and unlocking positions.

9. The device of claim 1 wherein said device further comprises:

a cover covering said key responsive lock operating means and having a keyhole therein so that said key responsive means is accessible from adjacent said device; and said master bar section has a shield rigidly mounted thereon so as to be movable therewith, said shield movable away from said keyhole when said master bar section is in a lock operating position and movable to block said keyhole when said master bar section is in another of the positions of said master bar section.

10. The device of claim 1 wherein said electrically actuatable lock operating means further comprises:

an electric motive device having a housing rigidly mounted on said support, and having a movable output shaft linked to said locking member.

11. The device of claim 10 wherein:

said electric motive device is a rotary motor and said shaft is the rotary output shaft of said motor; and said output shaft is linked to said locking member by drive linkage including a cam rigidly mounted on said shaft and rotatable therewith, and a cam follower carried by said locking member maintained in contact with said cam, said cam being shaped to move said locking member from its locking position to its unlocking position when said motor is actuated.

12. The device of claim 10 wherein:

said electric motive device is a linear solenoid having a linearly reciprocatable output shaft; and said output shaft is linked to said locking member to move said locking member from its locking position to its unlocking position when said solenoid is actuated.

13. The device of claim 1 wherein:

said master bar link is permanently rigidly connectable to said master bar sections; and said master bar section of said device is removably mountable to said support, whereby said device, with said master bar section removed therefrom and permanently connected into said master bar assembly, is removable from the frame.

14. The device of claim 1 wherein:

said release means includes a release cam portion and a release cam follower portion, one portion being carried by said master bar section, and the other portion being carried by said locking member.

15. The device of claim 14 wherein:

said release cam portion is rigidly mounted on said master bar section and said release cam follower portion is carried by said locking member.

16. The device of claim 1 wherein each lock operating position of said master bar section include:

a key position at which said key responsive lock operating means is operative to move said locking member from its locking position to its unlocking position; and an electric position at which said electrically actuatable lock operating means is operative to move said locking member from its locking position to its unlocking position.

17. The device of claim 16 wherein:

said device further comprises a cover covering said key responsive lock operating means and having a keyhole therein so that said key responsive means is accessible from adjacent said device; and said master bar section has a shield rigidly mounted thereon so as to be movable therewith, said shield being located away from said keyhole when said master bar section is in said key position so that said keyhole is accessible, and is located to block said keyhole when said master bar section is in said electric position.

18. The device of claim 1 wherein:

said release means includes a release cam rigidly attached to said master bar section, and a cam follower roller rotatably mounted to said locking member, said cam being located on said master bar section and said roller being located on said locking member so that said cam engages said cam follower roller and moves said locking member to its unlocking position as said master bar section is moved to its release position.

19. The device of claim 18 wherein said master bar section positions include a dead lock position, and said device further comprises:

a blocking piece rigidly mounted on said master bar section and positioned on said section so as to engage and block said cam follower roller when said master bar section is in said dead lock position so as to retain said locking member in its locking position.

20. The device of claim 1 wherein said master bar section positions include a dead lock position, and said device further comprises:

a blocking piece rigidly mounted on said master bar section and positioned on said section so as to engage and block said locking member when said master bar section is in said dead lock position so as to retain said locking member in its locking position.

21. The device of claim 1 wherein:

said master bar section is shorter than said master bar link; and said master bar link is a hollow light weight bar having a channel shaped cross-section.

* * * * *

UNITED STATES PATENT AND TRADEMARK OFFICE

CERTIFICATE OF CORRECTION

PATENT NO. : 4,982,528

DATED : January 8, 1991

INVENTOR(S) : Justin A. Michel

It is certified that error appears in the above-identified patent and that said Letters Patent is hereby corrected as shown below:

Column 14, line 9, "clock" should be --lock--

Column 16, line 43, "141" should be --141--

Column 18, line 30, "hand" should be --hang--

Signed and Sealed this

First Day of June, 1993

Attest:

Michael K. Kirk

MICHAEL K. KIRK

Attesting Officer

Acting Commissioner of Patents and Trademarks